US005547100A

United States Patent [19]

Johnson

[11] Patent Number: 5,547,100

[45] Date of Patent: Aug. 20, 1996

[54] BEVERAGE CAN INSECT COVER

[76] Inventor: Michael D. Johnson, Rte. 3, Box 321, Murray, Ky. 42071

[21] Appl. No.: 398,734

[22] Filed: Mar. 6, 1995

[51] Int. Cl.[6] ..... B65D 51/18

[52] U.S. Cl. ..... 220/253; 220/694; 220/730

[58] Field of Search ..... 220/253, 254, 220/367.1, 369–373, 336, 607, 694, 711, 714, 716, 719, 729–731; 222/481, 548, 565

[56] References Cited

U.S. PATENT DOCUMENTS

| | | | |
|---|---|---|---|
| 3,874,580 | 4/1975 | Weatherhead, III | 220/253 X |
| 4,537,326 | 8/1985 | Morehead | 220/906 X |
| 4,717,039 | 1/1988 | Ayyoubi | 220/336 X |
| 4,869,389 | 9/1989 | Cerrone, Jr. . | |
| 4,898,298 | 2/1990 | Norris | 220/711 |
| 4,938,379 | 7/1990 | Kellner . | |
| 5,054,640 | 10/1991 | Tucker | 220/254 X |
| 5,269,432 | 12/1993 | Beckertgis | 220/253 X |
| 5,402,904 | 4/1995 | Close | 220/730 X |

*Primary Examiner*—Allan N. Shoap
*Assistant Examiner*—Nathan Newhouse

[57] ABSTRACT

The inventive device includes a circular member positionable atop a beverage can. A semi-circular aperture directed through the circular member permits a projection of an opening lever of the can therethrough to secure the device to the can. A plurality of elongated apertures are directed through the circular member and are positioned for alignment with an opening of the can to permit egress of liquid from the can while precluding ingress of insects thereinto.

1 Claim, 3 Drawing Sheets

PRIOR ART

BEVERAGE CAN INSECT COVER

BACKGROUND OF THE INVENTION

1. Field of the Invention

The present invention relates to container covers and more particularly pertains to a beverage can insect cover for preventing ingress of an insect into a beverage container.

2. Description of the Prior Art

The use of container covers is known in the prior art. More specifically, container covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art container covers include U.S. Pat. Nos. 5,269,432; 5,125,525; 5,102,002; 4,901,877; and 4,869,389.

While these devices fulfill their respective, particular objectives and requirements, the aforementioned patents do not disclose a beverage can insect cover for preventing ingress of an insect into a beverage container which includes a circular member positionable atop a beverage can, with a semi-circular aperture directed through the circular member to permit a projection of an opening lever of the can therethrough, and a plurality of elongated apertures directed through the circular member and positioned for alignment with an opening of the can.

In these respects, the beverage can insect cover according to the present invention substantially departs from the conventional concepts and designs of the prior art, and in so doing provides an apparatus primarily developed for the purpose of preventing ingress of an insect into a beverage container.

SUMMARY OF THE INVENTION

In view of the foregoing disadvantages inherent in the known types of container covers now present in the prior art, the present invention provides a new beverage can insect cover construction wherein the same can be utilized for precluding ingress of insects into a beverage container. As such, the general purpose of the present invention, which will be described subsequently in greater detail, is to provide a new beverage can insect cover apparatus and method which has many of the advantages of the container covers mentioned heretofore and many novel features that result in a beverage can insect cover which is not anticipated, rendered obvious, suggested, or even implied by any of the prior art container covers, either alone or in any combination thereof.

To attain this, the present invention generally comprises an insect cover for preventing ingress of an insect into a beverage container. The inventive device includes a circular member positionable atop a beverage can. A semi-circular aperture directed through the circular member permits a projection of an opening lever of the can therethrough to secure the device to the can. A plurality of elongated apertures are directed through the circular member and are positioned for alignment with an opening of the can to permit egress of liquid from the can while precluding ingress of insects thereinto.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new beverage can insect cover apparatus and method which has many of the advantages of the container covers mentioned heretofore and many novel features that result in a beverage can insect cover which is not anticipated, rendered obvious, suggested, or even implied by any of the prior art container covers, either alone or in any combination thereof.

It is another object of the present invention to provide a new beverage can insect cover which may be easily and efficiently manufactured and marketed.

It is a further object of the present invention to provide a new beverage can insect cover which is of a durable and reliable construction.

An even further object of the present invention is to provide a new beverage can insect cover which is susceptible of a low cost of manufacture with regard to both materials and labor, and which accordingly is then susceptible of low prices of sale to the consuming public, thereby making such beverage can insect covers economically available to the buying public.

Still yet another object of the present invention is to provide a new beverage can insect cover which provides in the apparatuses and methods of the prior art some of the advantages thereof, while simultaneously overcoming some of the disadvantages normally associated therewith.

Still another object of the present invention is to provide a new beverage can insect cover for preventing ingress of an insect into a beverage container.

Yet another object of the present invention is to provide a new beverage can insect cover which includes a circular member positionable atop a beverage can, with a semi-circular aperture directed through the circular member to permit a projection of an opening lever of the can therethrough, and a plurality of elongated apertures directed through the circular member and positioned for alignment with an opening of the can.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
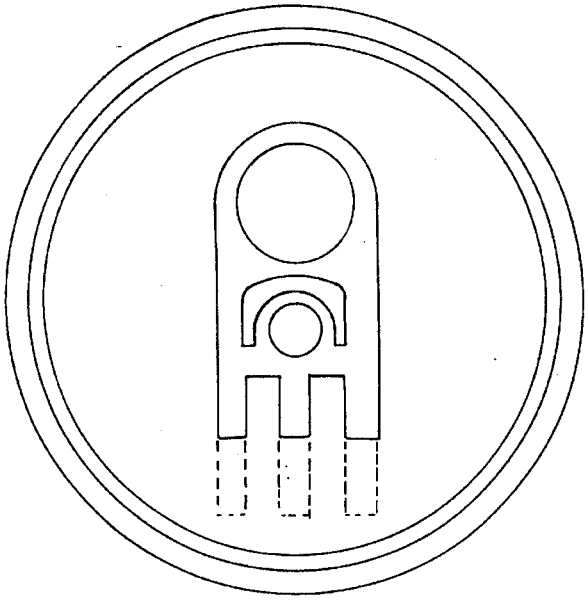
FIG. 1 is a top plan view of a prior art container cover.

With reference now to the drawings, and in particular to FIGS. 3–6 thereof, a new beverage can insect cover embodying the principles and concepts of the present invention and generally designated by the reference numeral 10 will be described.

Figure 2:
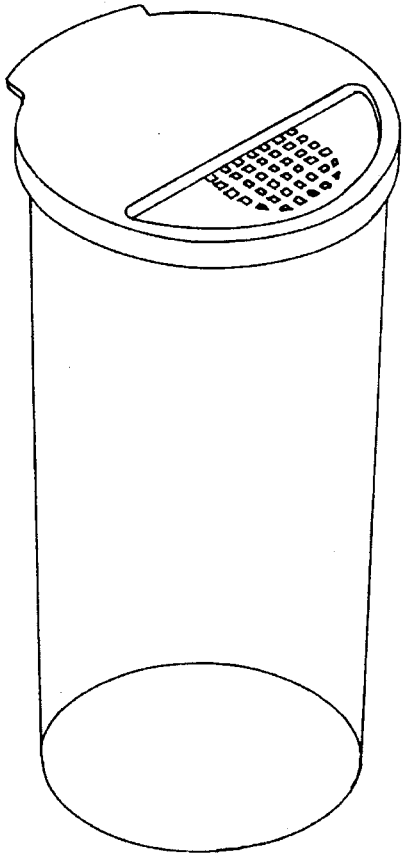
PRIOR ART Fig. 2
FIG. 2 is an isometric illustration of a further prior art container cover.

Turning initially to FIGS. 1 and 2 wherein prior art container covers are illustrated, it can be shown that the prior art teaches either a plurality of frangible apertures within a container top, as shown in FIG. 1, or a cover completely enclosing the top end of a container and including a plurality of small rectangular apertures directed therethrough as shown in FIG. 2.

Figure 3:
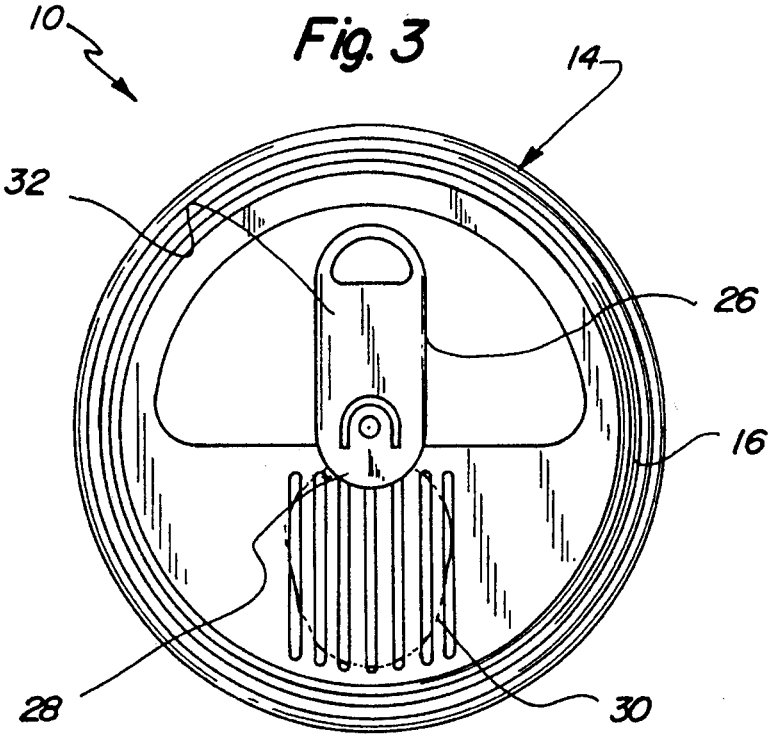
FIG. 3 is a top plan view of a beverage can insect cover according to the present invention in use.

Turning now to FIGS. 3 through 6 wherein the present invention 10 is illustrated in detail, it can be shown that the beverage can insect cover comprises a circular member 12 positionable atop a beverage can 14. The circular member 12 is dimensioned so as to reside within a projecting flange 16 of the top end of the beverage can. Thus, the flange 16 of the beverage can 14 is of a first diameter, with the circular member 12 being of a second diameter, wherein the first diameter is substantially greater than the second diameter so as to permit the circular member 12 to be positioned into abutting engagement with the upper surface of the beverage can as shown in FIG. 3.

Figure 4:
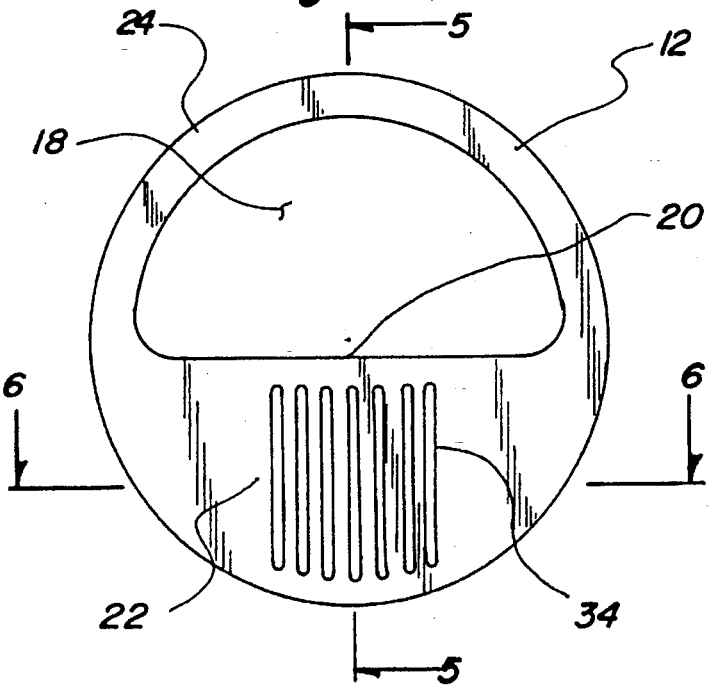
FIG. 4 is a top plan view of the invention, per se.

The circular member 12, as shown in FIG. 4, is shaped so as to define a semi-circular aperture 18 directed therethrough defining a straight separating edge 20 substantially dividing the circular member 12 in half to define a solid semi-circular portion 22 of the circular member 12 and an arcuate portion 24 extending about the semi-circular aperture 18 of the circular member. By this structure, an opening lever 26 of the beverage can 14 can be positioned through the semi-circular aperture 18. The opening lever 26 includes an engaging portion 28 utilized to create an opening 30 in the beverage can 14 and a handle portion 32. The straight separating edge 20 of the circular member 12 is positioned so as to extend slightly beneath the engaging portion 28 of the opening lever 26 when the device 10 is installed to the beverage can 14 as illustrated in FIG. 3. To this end, the handle portion 32 of the opening lever 26 can be rotated approximately 90 degrees from the position illustrated in FIG. 3, whereby the circular member 12 can thus be positioned flatly against the upper surface of the beverage can 14. The handle portion 32 of the opening lever 26 can then be rotated back into the position illustrated in FIG. 3 so as to position the engaging portion 28 thereof onto a portion of the solid semi-circular portion 22 of the circular member 12 so as to capture the portion of the solid semi-circular portion of the circular member between the top surface of the beverage can and a bottom surface of the engaging portion 28.

Figure 5:
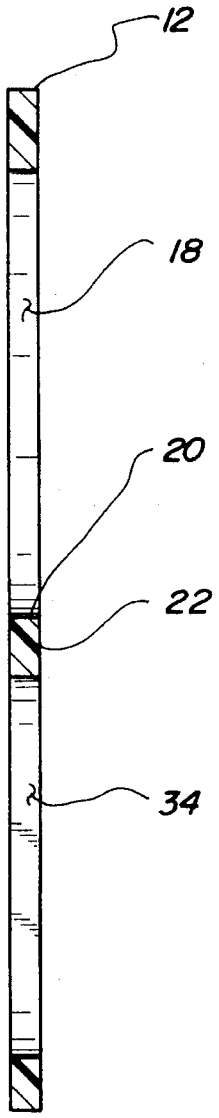
FIG. 5 is a cross-sectional view taken along line 5—5 of FIG. 4.
Figure 6:
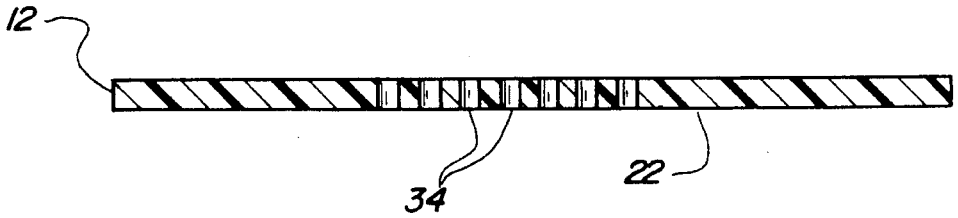
FIG. 6 is a cross-sectional view taken along line 6—6 of FIG. 4.

As shown in FIGS. 4 through 6, the solid semi-circular portion 22 of the circular member 12, when the device 10 is installed to the beverage can 14 as shown in FIG. 3, is positioned over the opening 30 of the beverage can. To permit egress of liquids from the beverage can 14, a plurality of elongated apertures 34 are directed through the solid semi-circular portion 22 of the circular member 12. By this structure, insects and the like are precluded from entering the beverage can 14, while liquids contained therein can be easily dispensed therefrom as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beverage can insect cover comprising:

a flat circular member positionable atop a beverage can, the circular member being shaped so as to be positionable within a projecting flange of a top end of the beverage can, the circular member having a plurality of elongated apertures directed therethrough the circular member for permitting egress of liquids from the beverage can, while precluding ingress of insects into the beverage can, wherein the circular member further has a semi-circular aperture directed therethrough defining a straight separating edge substantially dividing the circular member in half and an arcuate portion extending about the semi-circular aperture of the circular member, wherein an opening lever of the beverage can is positionable through the semi-circular aperture such that an engaging portion of the opening lever can be positioned to extend over the straight separating edge of the circular member so as to capture the circular member between a top surface of the beverage can and a bottom surface of the engaging portion of the opening lever of the beverage can.

* * * * *